US005333520A

United States Patent [19]

Fischer et al.

[11] Patent Number: 5,333,520

[45] Date of Patent: Aug. 2, 1994

[54] METHOD OF MAKING A CEMENTED CARBIDE BODY FOR TOOLS AND WEAR PARTS

[75] Inventors: Udo K. Fischer, Vällingby; Jan Aokerman, Stockholm; Bengt A. Asberg, Gävle; Stig E. Lagerberg, Sandviken, all of Sweden

[73] Assignee: Sandvik AB, Sandviken, Sweden

[21] Appl. No.: 62,715

[22] Filed: May 18, 1993

Related U.S. Application Data

[63] Continuation of Ser. No. 687,676, Apr. 19, 1991, abandoned.

[30] Foreign Application Priority Data

Apr. 20, 1990 [SE] Sweden ..... 90014093

[51] Int. Cl.[5] ..... B22F 7/06

[52] U.S. Cl. ..... 76/108.2; 76/DIG. 11; 419/10; 419/38; 419/65; 419/5; 407/119

[58] Field of Search ..... 76/101.1, 108.2, 108.1, 76/108.4, 108.6, DIG. 11; 407/118, 119; 419/5, 6, 38, 23, 14, 10, 65; 51/293, 298, 307, 309

[56] References Cited

U.S. PATENT DOCUMENTS

| | | | |
|---|---|---|---|
| 3,429,700 | 2/1969 | Wiegand et al. . | |
| 3,665,585 | 5/1972 | Dunn et al. | 419/38 |
| 4,082,559 | 4/1978 | Mishuku et al. . | |
| 4,280,841 | 7/1981 | Ito et al. | 419/14 |
| 4,437,800 | 3/1984 | Araki et al. . | |
| 4,478,611 | 10/1984 | Selden . | |
| 4,496,372 | 1/1985 | Almond et al. . | |
| 4,595,219 | 6/1986 | Hostatter et al. . | |
| 4,629,373 | 12/1986 | Hall . | |
| 4,661,180 | 4/1987 | Frushour . | |
| 4,662,896 | 5/1987 | Dennis . | |
| 4,705,124 | 11/1987 | Abrahamson et al. . | |
| 4,713,286 | 12/1987 | Bunting et al. . | |
| 4,857,411 | 8/1989 | Yamaguchi et al. | 419/10 |
| 4,911,254 | 3/1990 | Keith . | |
| 5,183,632 | 2/1993 | Kiuchi et al. | 419/10 |

FOREIGN PATENT DOCUMENTS

| | | |
|---|---|---|
| 2651311 | 1/1983 | Fed. Rep. of Germany . |
| 1522955 | 4/1968 | France . |
| 2223472 | 11/1974 | France . |
| 87/06863 | 11/1987 | PCT Int'l Appl. . |
| 8803769 | 4/1990 | Sweden . |
| 233609 | 11/1944 | Switzerland . |
| 1152712 | 4/1985 | Switzerland . |
| 1034386 | 6/1966 | United Kingdom . |

*Primary Examiner*—Roscoe V. Parker
*Attorney, Agent, or Firm*—Burns, Doane, Swecker & Mathis

[57] ABSTRACT

A method for manufacturing of a cemented carbide body for cutting tools, rock drilling tools or wear parts with complicated geometry characterized in that the body is sintered together from simpler pressed but unsintered parts to form a body with desired complex geometry.

21 Claims, 5 Drawing Sheets

FIG. 3A
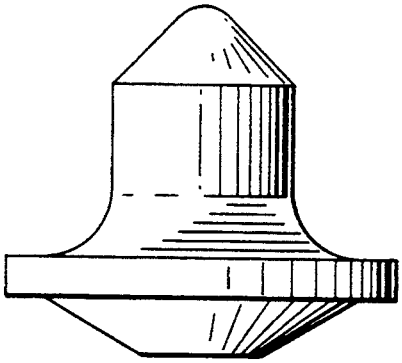
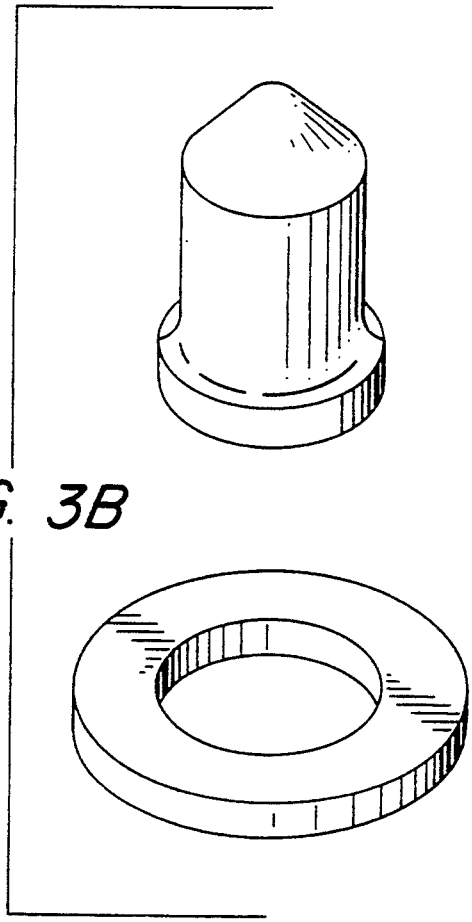
FIG. 3B
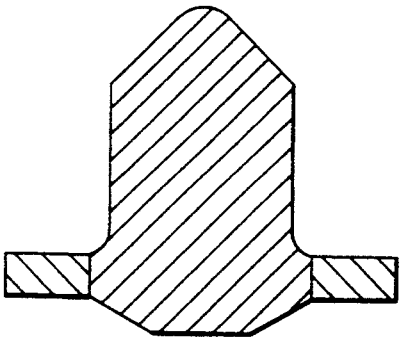
FIG. 3C
FIG. 4B
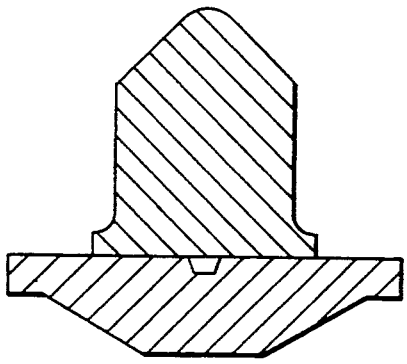
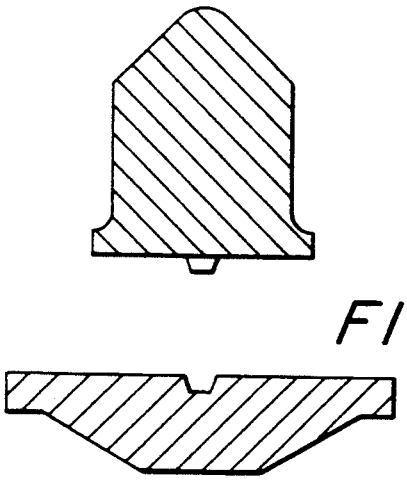
FIG. 4A

METHOD OF MAKING A CEMENTED CARBIDE BODY FOR TOOLS AND WEAR PARTS

This application is a continuation of application Ser. No. 07/687,676, filed Apr. 19, 1991 and now abandoned.

The present invention relates to a method of making a cemented carbide body for rock and metal drilling tools and wear parts. The method is particularly useful for the preparation of such a cemented carbide body which for some reason, e.g., the outer shape, cannot be directly pressed to final form by uniaxial pressing.

Cemented carbide bodies are usually made by powder metallurgical methods, namely, pressing and sintering. The desired form of the sintered body has to be obtained as far as possible before sintering because machining of the sintered body is expensive, and in most cases, even unprofitable. Machining to desired shape is therefore done, if necessary, in the as-pressed and/or presintered condition after which the body is finally sintered. Even this is an expensive operation. For said reasons, the body is generally given such a form that it can be directly pressed by uniaxial pressing to the final shape. That means, however, that there are great limitations on the shape of the final piece. For example, the necessity of positive clearances in the pressing direction, a critical height to width ratio, no abrupt transitions from small to large diameter, etc., must all be taken into account. This means that the final shape of a cemented carbide body such as a rock and metal drilling tool or wear part body is usually a compromise between what is possible to produce by uniaxial pressing and the shape which is really desired.

In certain cases, bodies with complicated geometry can be made by use of a collapsible tool in which the die after the pressing is divided in order to expose the compact. Such tools are expensive, however, and sensitive to the high compacting pressures being used in the production of cemented carbide. This method is suitable for use in the production of bodies in large numbers, e.g., cutting inserts and buttons for rock drilling tools which can carry the costs of producing the necessary pressing tools. For bodies made in smaller numbers such as wear parts, one usually starts from a simpler body which is then machined to the desired shape. Said machining is expensive with often great material loss because large volumes usually have to be removed. Also in this case, the final form is a compromise between desired form and what is possible and reasonable, technically as well as economically.

It has now been surprisingly found that it is possible to produce cemented carbide bodies in a relatively simple way by pressing partial bodies each of simple geometry, capable of being directly pressed, after which said partial bodies are sintered together to form a body with a desired, often complex geometry. One example of the type of body to which this technique is applicable is SE pat. appl. 8803769-2 which relates to a double-positive cutting insert for chipforming machining. The method can also be used for making other bodies of cemented carbide, e.g., rods or blanks for drills and end mills, rock drilling tools and wear parts. The body can also be made of other hard materials, e.g., ceramics or carbonitride-based materials the so-called cermets.

According to the present invention, there is now available a method of making preferably complex cemented carbide bodies other than inserts for metal cutting by dividing the body into smaller partial bodies which are individually compacted, placed upon each other with the joint lying essentially horizontally and then sintered. By this procedure, the bodies are sintered together into a homogenous body. The joint is usually not visible and therefore the strength is fully comparable with the strength of a directly compressed body. It is suitable that the joint, if possible, is placed so that symmetrical partial bodies are obtained. Furthermore, it is suitable that the surfaces which shall be connected are provided with one or more nobs and protrusions in one surface and grooves or recesses in a corresponding mating surface to thus fix the relative position of the partial bodies during the sintering. The partial bodies may also (or alternatively) be placed in a suitably shaped fixture to fix their position during sintering. It is naturally desirable that the partial bodies be given their final shape already by pressing but it is naturally also possible to shape the partial bodies to some extent also after pressing.

The method according to the present invention makes it possible in certain cases to produce cemented carbide bodies simpler and cheaper with better performance. Examples of cemented carbide bodies according to the invention are shown in FIGS. 1–6.

In these figures,

FIG. 1A shows a seal ring conventionally made in one piece; while

FIGS. 2A–2B show front and side views of a button for raise boring conventionally made in one piece; while

FIG. 3A shows a cemented carbide body for mineral cutting and road planning conventionally made in one piece; while FIG. 3C show a cemented carbide body for mineral cutting and road planing of the present invention made of the two pieces 3B;

FIGS. 4A–4B shows a similar cemented carbide body for mineral cutting and road planing as in FIG. 3C made of the two pieces 4A;

It is obvious for a person skilled in the art how the method according to the invention can be applied also to other embodiments of hard metal carbides.

The method can also be used for making a body of cemented carbide of two or more grades being different with respect to composition and/or grain size, e.g., a tough core with a wear resistant cover and vice versa. In the production of such hard metal bodies, it is important that the shrinkage is similar in both bodies to avoid cracking. This kind of compound grade hard metal is particularly suitable for use when parts are to be brazed because a cobalt-rich, tough cemented carbide is easier to braze than a cobalt-poor cemented carbide. This depends upon the differences in thermal expansion coefficient. Steel has high thermal expansion while cemented carbide has a low thermal expansion. Cemented carbide with high cobalt content has a higher expansion than cemented carbide with low content of cobalt. Cemented carbide with a low content of cobalt is difficult to braze because of increased risks for cracking of the parts due to high brazing stresses and brittle material. By the present invention, an optimal grade for the application can be used without making any particular consideration to its brazeability.

In a preferred embodiment, conventional, so-called gas pressure sintering of the body is used as the sintering process. This means that the body is first sintered under normal pressure. When closed porosity has been obtained, the pressure is increased and final sintering is performed under increased pressure. In this way an increased strength in the body is obtained and the joint will easily sinter to full density. Otherwise, conventional pressing and sintering techniques may be used.

The invention is additionally illustrated in connection with the following Examples which are to be considered as illustrative of the present invention. It should be understood, however, that the invention is not limited to the specific details of the Examples.

EXAMPLE 1

Figure 1A:
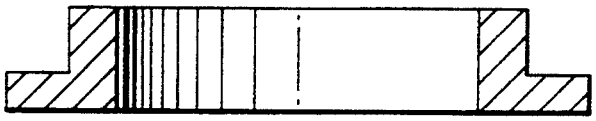
Figure 1B:
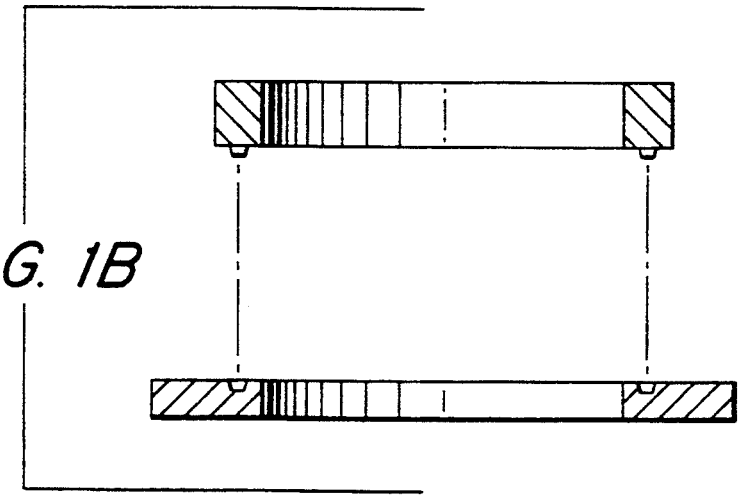
Figure 1C:
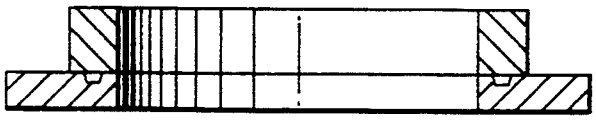
FIG. 1C show a seal ring of the present invention made of the two pieces 1B.

In the conventional manufacture of seal rings, FIG. 1A, there are problems in form of cracks at the transition from the larger outer diameter to the smaller outer diameter. The reason is the difference in the degree of compaction between the top and bottom parts. During the sintering of the ring, great differences in shrinkage will consequently be obtained which leads to cracking in the transition zone. Manufacturing of the ring according to the invention, FIGS. 1B–1C, was done in the following way: The ring was principally divided in two rings, FIG. 1B. The upper ring (FIG. 1B) had the dimensions $\Phi_0 = 50.4$ mm, $\Phi_1 = 45.7$ mm and h = 7.15 mm and the lower ring (FIG. 1B) $\Phi_0 = 60.0$ mm, $\Phi_1 = 45.7$ mm and h = 4 mm. In order to fix the rings to each other during the sintering process, the upper ring was provided with four protrusions 5 and the lower ring with four corresponding grooves 6. Before sintering, the upper ring was placed upon the lower ring so that the projections 5 and the grooves 6 fit together and locked the relative position of the upper and lower rings. The sintering was performed in vacuum at 1450° C. for 2 hr. sintering time. The material was a corrosion resistant cemented carbide grade having a binder phase of type Ni—Cr—Mo and a hardness of 1520 HV3. This grade is regarded as difficult to press. In the test, 1000 rings were manufactured according to conventional method, i.e., with direct-pressing of the whole part. At the same time 1000 rings according to the invention were sintered. The rings were examined with respect to cracks with the following results:

| Variant | With Cracks | Without Cracks |
|---|---|---|
| Conventionally made rings | 262 | 738 |
| Rings according to the invention | 0 | 1000 |

In addition, a metallurgical examination of the rings according to the present invention showed that the structure was free of defects. Even at high magnification (1500 ×) no joint could be observed except in connection to the fixing elements.

EXAMPLE 2

Figure 2A:
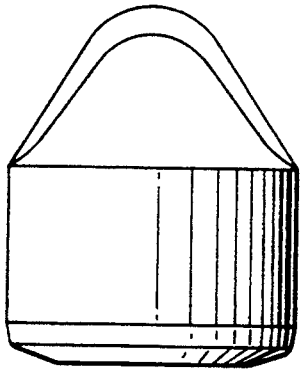
Figure 2B:
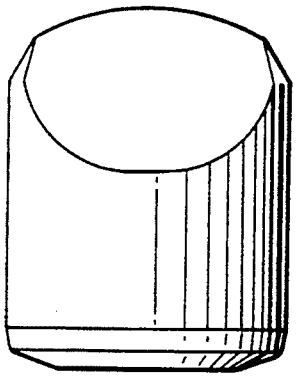
Figure 2C:
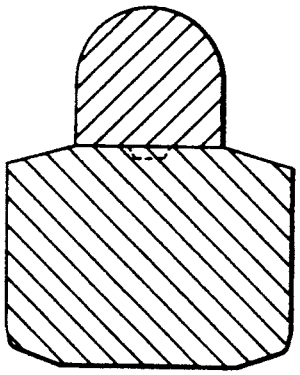
FIGS. 2C–2D show front and side views of a button for raise boring made of the present invention made of the two pieces.
Figure 2D:
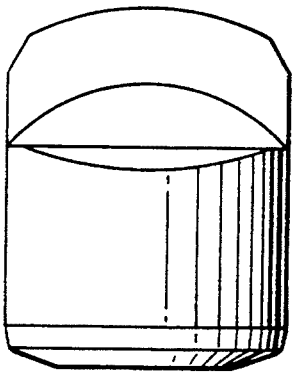

Buttons for raise boring according to FIG. 2 were manufactured according to the present invention, FIGS. 2C–2D, (500 pieces), and by conventional direct-pressing technique, FIGS. 2A–2B, (500 pieces). The cemented carbide had the composition 8% Co, 92% WC and a hardness of 1250 HV3. The buttons according to the invention consisted of two separately pressed parts, shown in FIG 2C and FIG. 2D. During the sintering, the chisel part was placed on the cylindrical part. The fixing was done by two protrusions in the chisel part and corresponding grooves in the cylindrical part (not shown). An ocular examination gave the following results:

| Variant | With Cracks | Without Cracks |
|---|---|---|
| Conventionally made buttons | 86 | 414 |
| Buttons according to the invention | 0 | 500 |

Because the cracks were small and therefore difficult to detect by an ocular examination, it was assumed that several buttons regarded as free of cracks might have had cracks. For that reason, twelve buttons per variant were examined metallographically. However, all buttons according to the invention were free of cracks. The joint between the two parts sintered together could not be observed in 1500 × magnification except in connection to the protrusions/grooves. Eight of the conventionally manufactured buttons showed cracks 0.3–0.6 mm deep. Only four of these had been detected by the ocular inspection.

EXAMPLE 3

A cemented carbide body for mineral cutting and road planing according to FIG. 3 with 11% Co and a grain size of 4 μm (1130 HV3) was directly pressed and sintered according to standard procedure, FIG. 3A. The degree of compaction will be very high at the wall of the die and press-cracks of up to 1 mm could be observed in the collar after the sintering. If the pressing is performed with a lower compaction pressure, the risks for cracks are decreased but the degree of compaction in the center of the body will then be so low that an unacceptably high porosity level is obtained.

Instead, a cylindrical body was made according to the invention like an ordinary rock tool button (FIG. 3C) or a button and an outer ring (FIG. 3B). The button was placed within the ring and the whole was sintered. By choosing the compaction pressure so that the ring shrunk somewhat more than the button during the sintering, a body (FIG. 3C) without a visible joint was obtained.

EXAMPLE 4

Bodies according to the preceding example were manufactured by pressing and sintering together a short button, and a bottom disk (FIG. 4A) to form a rock tool button as in FIG 4B. The button had a protrusion 5 in the bottom and the disk had a corresponding groove by which the bodies were fixed relatively to each other during the sintering.

EXAMPLE 5

In the same way as in Example 4, and FIG. 4B, a number of bodies were pressed with the difference that the button, had a cemented carbide composition containing 8% Co and 5 μm grain size (1230 HV3) and the bottom disk, had a cemented carbide composition containing 15% Co and 3.5 μm grain size with the hardness 1050 HV3. The body was placed upon the body and the whole was sintered at 1410° C. for 2 hr. After the sintering, one body was prepared metallographically and a uniform transition between the two cemented carbide grades could be seen in an about 500 μm wide zone. The remaining bodies were brazed in milling tools for comparing tests in middle-hard sandstone with the following results:

| Variant | Hardness, HV3 | Milled length, m |
|---|---|---|
| According to the invention | 1230(1050) | 936 |
| Homogenous hard metal | 1050 | 375 |
| Homogenous hard metal | 1230 | several brazing cracks gave 300 (mean value) |

The reason for the improved result of the body according to the invention is the combination of a hard and wear-resistant tip on a tougher bottom-part which can better handle the brazing stresses.

EXAMPLE 6

Figure 5A:
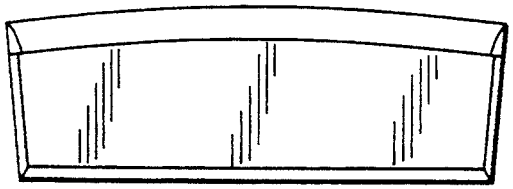
FIGS. 5E–5F show front and side views of a chisel insert of the present invention made of two outer pieces, one of which is shown in front and side views in FIGS. 5A–5B and a central piece front and side views of FIGS. 5C–5D.
Figure 5B:
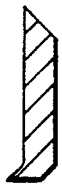
Figure 5C:
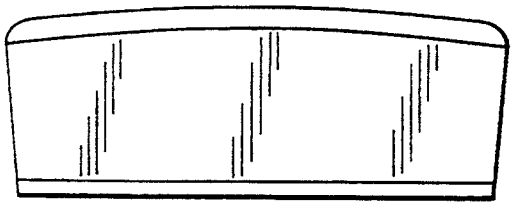
Figure 5D:
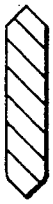
Figure 5E:
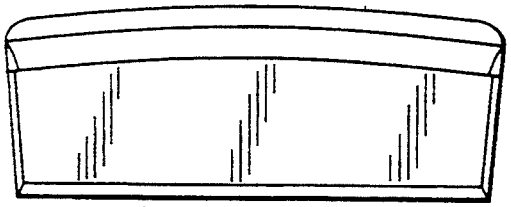
Figure 5F:
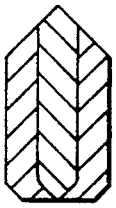

Chisel inserts for rock drilling tool bits are usually brazed in a milled groove in the bit-end of a drill rod. The inserts consist conventionally of grades with 8–11% Co and 2.5–5 μm grain size. Chisel inserts (FIG. 5E–5F) were manufactured according to the invention from three together-sintered lamellae in which the intermediate lamella (FIGS. 5C–5D) has a lower content of cobalt while the two outer surrounding ones (FIGS. 5A–5B) have a higher cobalt content.

When drilling in granite-leptite with rock drill BBC-35 and 3 m hole length six rods type H22 were drilled with conventional chisel inserts as well as with chisel inserts according to the invention. The inserts were 10 ×17 mm. The outer parts (FIGS. 5A–5B) were cemented carbide containing 9.5% Co and 3.5 μm WC with 1200 HV3 while the intermediate part (FIGS. 5C–5D) were cemented carbide containing 6% Co and 2.5 μm grain size with 1430 HV3. The conventional insert had 8% Co and 3.5 μm WC with 1280 HV3. Results:

| Variant | No. of regrindings | Life, m |
|---|---|---|
| Conventional | 8 (every 6th hole) | 148 |
| According to the invention | 6 (every 10th hole) | 180 |

EXAMPLE 7

Figure 6:
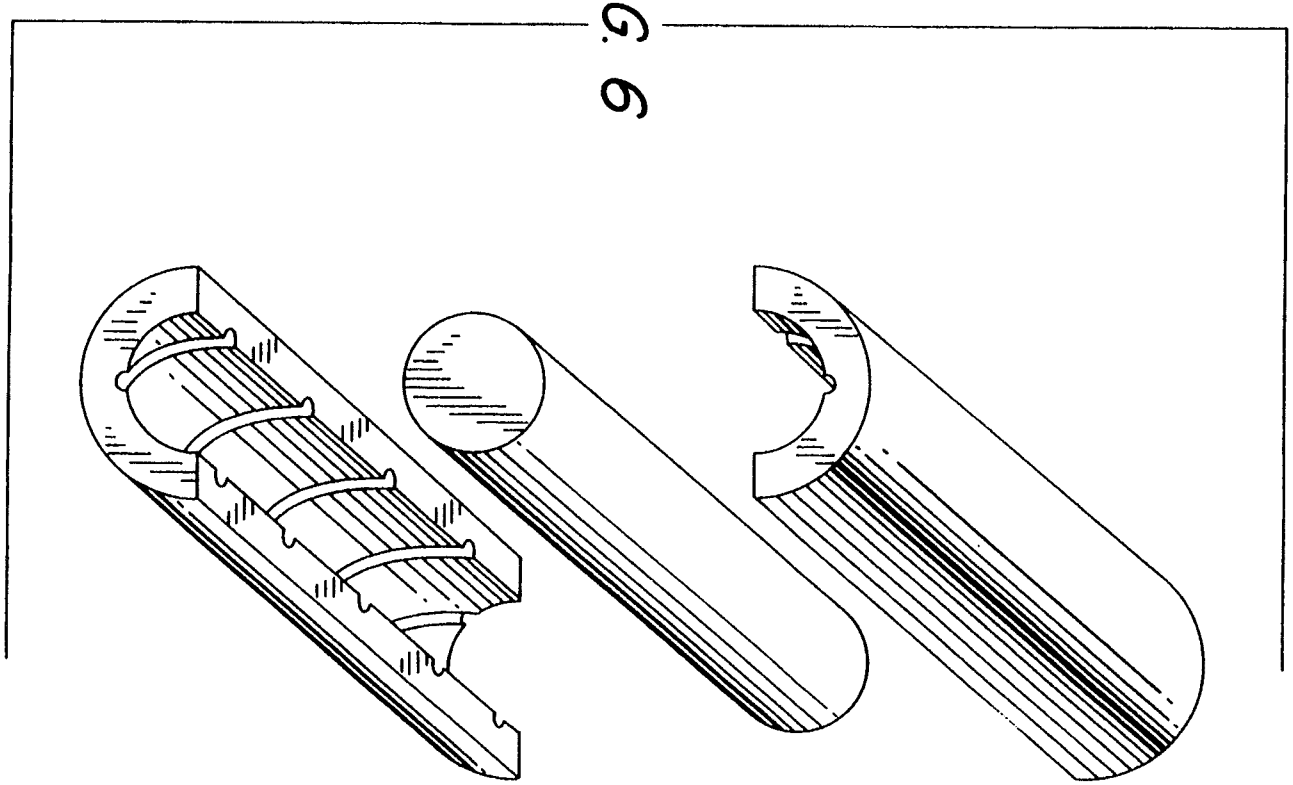
FIG. 6 shows a blank for solid cemented carbide drills in exploded form made of three pieces.

Blanks for solid cemented carbide drills (diam. 6 mm, length 700 mm) with internal coolant channels were manufactured by sintering together three pieces according to FIG. 6. The individual pieces were tool pressed in an automatic mechanical press. The outer parts contained grooves to form the helicant coolant channels in the final product and means for securing the relative positions of the pieces during sintering.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. A method of making a cemented carbide cutting tool, rock drilling tool or wear part, comprising placing first and second precompacted bodies consisting essentially of metallic carbide powder and a small amount of metal powder upon each other such that the first precompacted body is only on one side of the second precompacted body and sintering the first and second precompacted bodies to form a sintered cemented carbide body.

2. The method of claim 1, wherein the sintered body has such a form that it cannot be directly pressed to final shape by uniaxial pressing.

3. The method of claim 1, wherein the sintering is started at normal pressure which is increased when closed porosity has been obtained in the body.

4. The method of claim 1, wherein at least one of said first precompacted body has a composition different from said second precompacted body.

5. The method of claim 1, wherein said first and second precompacted bodies include means for locating said first body relative to said second body during sintering to achieve proper alignment of said bodies.

6. The method of claim 5, wherein said means includes at least one protuberance on one of said bodies and a corresponding recess on another one of said bodies.

7. The product of the process of claim 1.

8. A method of making a cemented carbide body, comprising steps of:

forming a first preshaped body consisting essentially of metallic carbide powder and a binder metal powder, the first preshaped body being formed by compacting the metallic carbide and binder powder;

forming a second preshaped body consisting essentially of metallic carbide powder and a binder metal powder, the second preshaped body being formed by compacting the metallic carbide and binder powder;

placing the first preshaped body on the second preshaped body such that the first preshaped body is on only one side of the second preshaped body; and sintering the first and second preshaped bodies to form a cemented carbide body.

9. The method of claim 8, wherein the first and second preshaped bodies have different shapes.

10. The method of claim 8, wherein the first and second preshaped bodies have different compositions.

11. The method of claim 8, wherein mating flat surfaces on the first and second preshaped bodies are joined together during the sintering step.

12. The method of claim 8, wherein the metallic carbide powder comprises WC.

13. The method of claim 8, wherein the metal binder powder comprises up to about 15 wt. % Co.

14. The method of claim 8, wherein the sintering is performed in a vacuum.

15. The method of claim 8, wherein the sintering is performed while the first and second preshaped bodies are under pressure.

16. The method of claim 8, wherein a protrusion on the first preshaped body is fitted in a recess in the second preshaped body during the step of placing the first preshaped body on the second preshaped body.

17. The method of claim 8, wherein the sintering step is carried out under pressure and the pressure is increased when closed porosity is obtained in the first and second preshaped bodies.

18. The method of claim 8, wherein the first preshaped body comprises a first ring and the second preshaped body comprises a second ring, the second ring having a larger outer diameter than the first ring and the first and second rings having equal inner diameters, the first and second rings being arranged such that the inner diameters are concentric when the first ring is placed on the second ring.

19. The method of claim 8, wherein the first preshaped body comprises a chisel part and the second preshaped body comprises a cylindrical part.

20. The method of claim 8, wherein the first preshaped body comprises a rock tool button and the second preshaped body comprises a bottom disk.

21. The product of the process of claim 8.

* * * * *